US006646563B1

(12) United States Patent
Buckley et al.

(10) Patent No.: US 6,646,563 B1
(45) Date of Patent: Nov. 11, 2003

(54) DEFLECTION SENSORS

(75) Inventors: Nigel James Sinclair Buckley, Ashburton (AU); Gregory Richard Hellard, Glen Iris (AU)

(73) Assignee: Gryffin Pty. Ltd., Bayswater (AU)

( * ) Notice: Subject to any disclaimer, the term of this patent is extended or adjusted under 35 U.S.C. 154(b) by 0 days.

(21) Appl. No.: 09/857,261

(22) PCT Filed: Dec. 3, 1999

(86) PCT No.: PCT/AU99/01077

§ 371 (c)(1),
(2), (4) Date: Jun. 1, 2001

(87) PCT Pub. No.: WO00/33273

PCT Pub. Date: Jun. 8, 2000

(30) Foreign Application Priority Data

Dec. 3, 1998 (AU) ..... PP7486

(51) Int. Cl.[7] ..... G08B 21/00

(52) U.S. Cl. ..... 340/668; 340/665; 340/541; 340/564; 256/1; 256/10

(58) Field of Search ..... 340/668, 665, 340/541, 564, 565, 566, 567; 200/61.93; 256/1, 10, 32, 33, 42

(56) References Cited

U.S. PATENT DOCUMENTS

| | | | | | |
|---|---|---|---|---|---|
| 3,803,548 | A | * | 4/1974 | Skujins, Jr. | 340/566 |
| 4,367,459 | A | | 1/1983 | Amir et al. | |
| 4,500,873 | A | | 2/1985 | Porat et al. | |
| 4,730,809 | A | * | 3/1988 | Stoler | 256/1 |
| 4,829,287 | A | * | 5/1989 | Kerr et al. | 340/541 |
| 4,906,975 | A | | 3/1990 | Casella et al. | |
| 5,103,207 | A | * | 4/1992 | Kerr et al. | 340/541 |
| 5,268,672 | A | | 12/1993 | Kerr | |
| 5,371,488 | A | * | 12/1994 | Couch et al. | 340/541 |
| 5,392,027 | A | | 2/1995 | Brunot et al. | |
| 5,434,557 | A | * | 7/1995 | Alizi | 340/555 |
| 5,461,364 | A | * | 10/1995 | Sanford et al. | 340/541 |
| 5,578,990 | A | * | 11/1996 | Sanford et al. | 340/541 |
| 5,602,534 | A | | 2/1997 | Granat | |

FOREIGN PATENT DOCUMENTS

| | | |
|---|---|---|
| AU | 6602486 A1 | 6/1987 |
| AU | 63711/90 | 2/1991 |
| EP | 0246487 B1 | 11/1991 |

* cited by examiner

*Primary Examiner*—Nina Tong
(74) *Attorney, Agent, or Firm*—Nath & Associates PLLC; Gary M. Nath; Marvin C. Berkowitz

(57) ABSTRACT

A deflection sensor for a taut wire perimeter fence detection system, which can be installed after the fence wire has been installed easily, and the sensor the operates in line with the wire tension. The sensor includes a plate member adapted to be pivotally mounted, a first wire attachment point at one end of said plate member, a second wire attachment point remote from said first wire attachment point and a transducer or sensor element located on said plate member between the attachment points. The taut wire type detection system including at least one taut wire for a perimeter fence supported by a plurality of posts, at least one deflection sensor being pivotally mounted to one of the posts or a support thereon and a sensor processing circuit for interrogating the at least one deflection sensor and to provide an alarm indication on tampering of the at least one taut wire or the at least one deflection sensor.

9 Claims, 6 Drawing Sheets

DEFLECTION SENSORS

This invention relates to a deflection sensor and relates particularly, though not exclusively, to a deflection sensor for a taut wire perimeter fence detection system and the system per se.

A taut wire fence operates as a number of parallel wires attached between two anchor posts. Each of the wires acts as a spring if there is an attempt to move a wire. Attached to each wire is a sensor which when displaced, causes an alarm. Also, cutting any wire causes the sensor to be displaced by tension from the uncut section of the wire. Such a system has a very low false alarm rate and is not disturbed in most environmental conditions. The use of a barbed wire also poses a deterrent to intrusion. A fence structure is also a barrier which clearly defines a perimeter or border. Such systems have been available for many years and examples of these systems may be found in U.S. Pat. Nos. 5,392,027, 5,602,534, 5,268,672, 4,730,809, 4,500,873 and 4,367,459.

In a taut wire fence installation, the sensor post is installed and, depending on the system, the wire sensors are mechanically disconnected from the fence fabric allowing the correct tension to be applied to each fence wire. Once the fence fabric is correctly tensioned and stable, the sensors are mechanically coupled to the fabric of the fence. It is during this stage that the wire sensors are most vulnerable. Incorrect tension settings may cause the sensor to be over strained and in the process damaged or destroyed. Systems employing a sensor that is transverse to the strained fence or wire are particularly sensitive to this action.

It is an object of the present invention to provide a sensor that can be installed after the fence wire has been installed.

A further object of the invention is to provide a sensor that is easy to install.

A still further object is to provide a sensor that operates in line with the wire tension.

With these and other objects in view the present invention provides a deflection sensor for a taut wire type detection system, said deflection sensor including a plate member adapted to be pivotally mounted, a first wire attachment point at one end of said plate member, a second wire attachment point remote from said first wire attachment point and a transducer or sensor element located on said plate member between said attachment points.

Preferably said attachment points are at opposite ends of said plate member and/or on opposite sides of said plate member. In a practical embodiment said attachment points are formed from tabs bent from said plate member to extend on opposite sides of said plate member and said tabs include a slot for reception of said wire. Preferably said plate member includes a further slot at the bottom of said plate member to guide the wire from one side to the other side of said plate member. Preferably a cut out or slot is formed in said plate member adjacent said transducer to increase the sensitivity of said sensor. In a further practical embodiment said sensor is pivotally mounted on a shock absorber means. The transducer or sensor element is preferably a strain gage device.

The invention also relates to a taut wire type detection system including at least one taut wire for a perimeter fence supported by a plurality of posts, at least one deflection sensor of the type previously defined being pivotally mounted to one of said posts or a support thereon and a sensor processing circuit for interrogating said at least one deflection sensor and to provide an alarm indication on tampering of said at least one taut wire or said at least one deflection sensor.

In order that the invention may be more readily understood and put into practical effect, reference will now be made to the accompanying drawings, in which.

In FIGS. 1 to 10 of the drawings there is shown a portion of a perimeter fence system 10 having a number of posts 12 and wires 14 strung between the posts 12. The wires 14 are under tension to form a taut wire type detection system to secure an area enclosed by the fence system 10. It should also be noted that, although horizontal wires 14 are shown, the invention is equally applicable to vertical taut wire perimeter fence systems. Wires 14 can be barbed wire or any other wire to suit requirements. A plurality of deflection sensors 16 are pivotally attached to a number of posts 12 or to supports on the posts.

Figure 1:
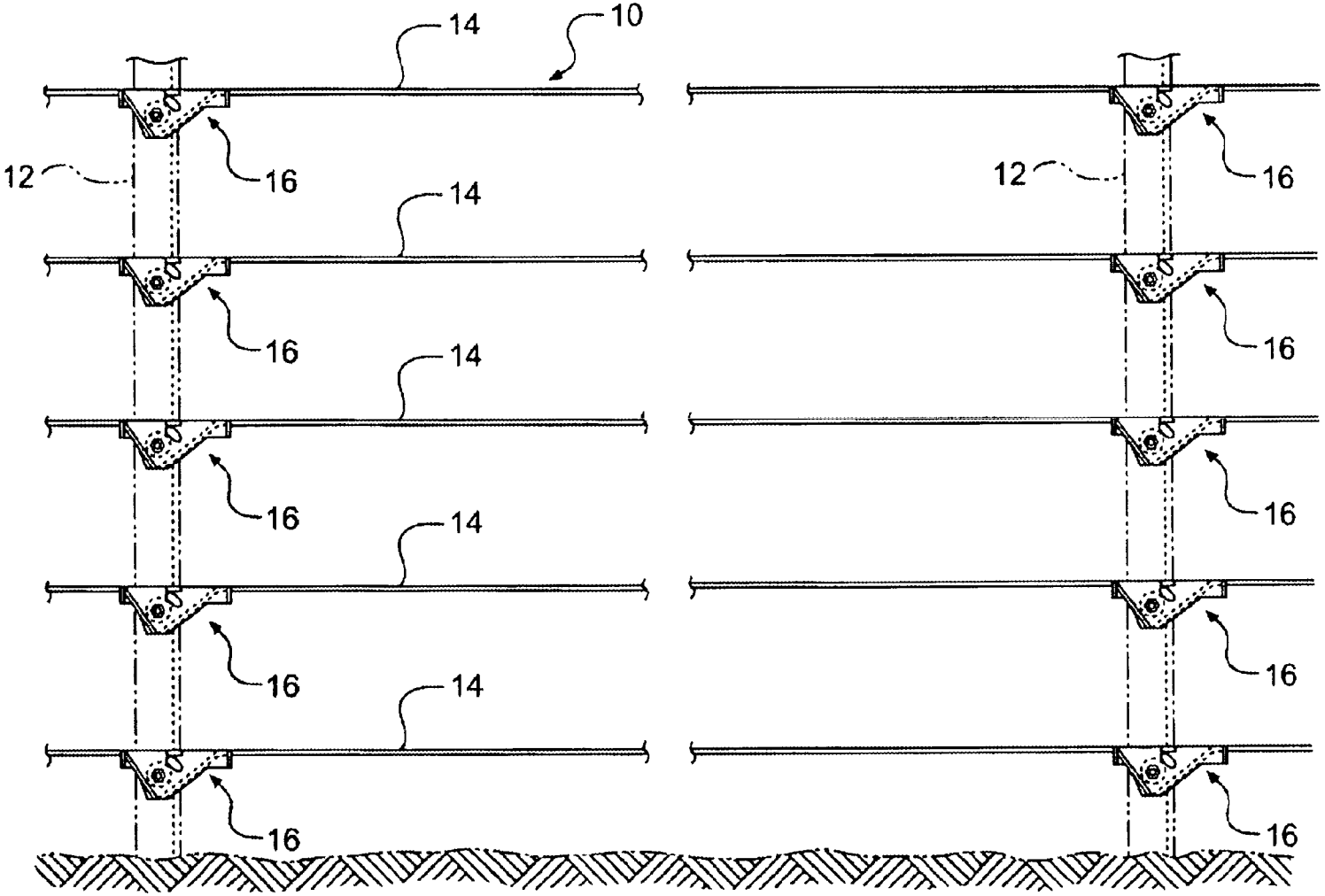
FIG. 1 is a pictorial representation of a perimeter fence employing a plurality of deflection sensors made in accordance with a preferred embodiment of the invention.
Figure 2:
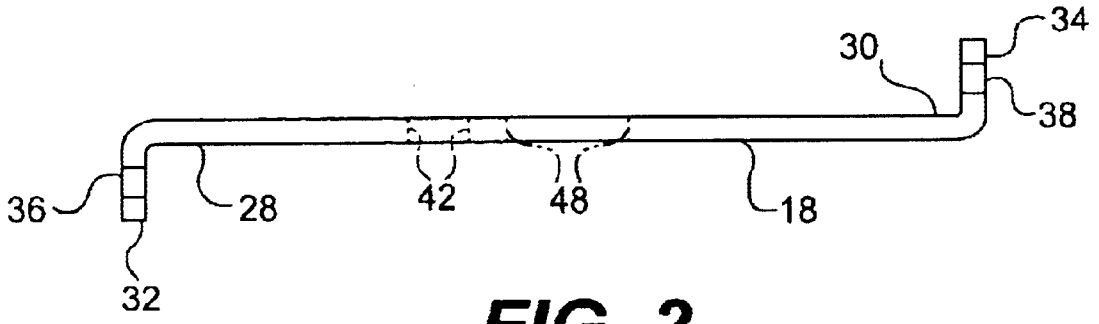
FIG. 2 is a plan view of the plate member of the sensor shown in FIG. 1.
Figure 3:
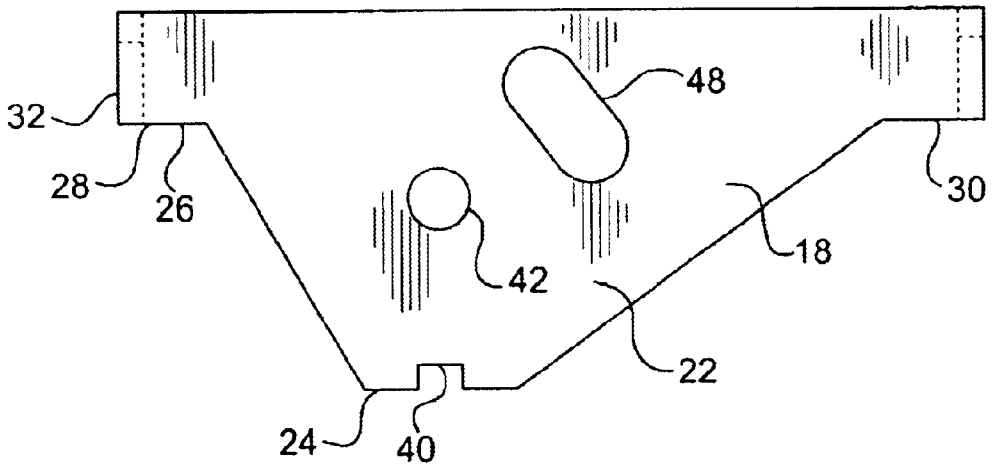
FIG. 3 is a side view of the plate member shown in FIG. 2.
Figure 4:
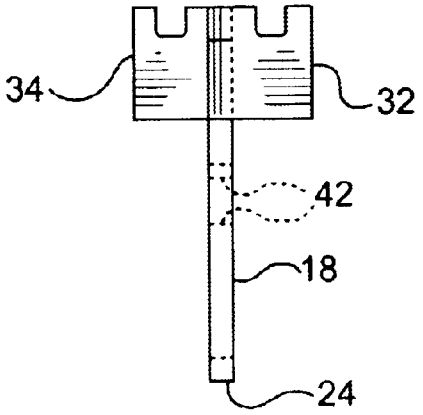
FIG. 4 is an end view of the plate member shown in FIG. 2.

Sensor 16 comprises a plate member 18 and transducer or sensor element 20, preferably a strain gage or similar device. Plate member is formed of a metallic material typically hardened aluminium plate. The strain gage may use a conventional Wheatstone bridge circuit and is manufactured as a laminate that may be affixed to the plate member 18. Such strain gages are commercially available on insulation films, such as polymer tape, for application to plate member 18. The type or operation of such strain gages do not form part of the invention. FIGS. 2 to 4 show the shape of the plate member 18 that has been found to be very effective in practice. Plate member 18 has a triangular main part 22 with a truncated bottom 24. Along one side there is a band 26 which extends at either end to form tabs 28,30. Tab 28 has an end member 32 bent at right angles to tab 28 and tab 30 has an end member 34 bent at right angles to tab 30 but on the opposite of triangular main part 22. End members 32,34 have slots 36,38 for supporting and guiding wire 14. A further slot 40 is provided in the truncated bottom 24 for reception and guiding of wire 14. A mounting hole 42 located off centre is provided for fixing to post 12 by a rod 44 having threaded ends with cooperating nuts 46,52. A cut out 48 adjacent transducer 20 will focus the stress to the transducer 20 to increase the sensitivity of the transducer. Sensitivity can also be increased by reducing the thickness of plate member 18 on the opposite side of the plate member.

Figure 5:
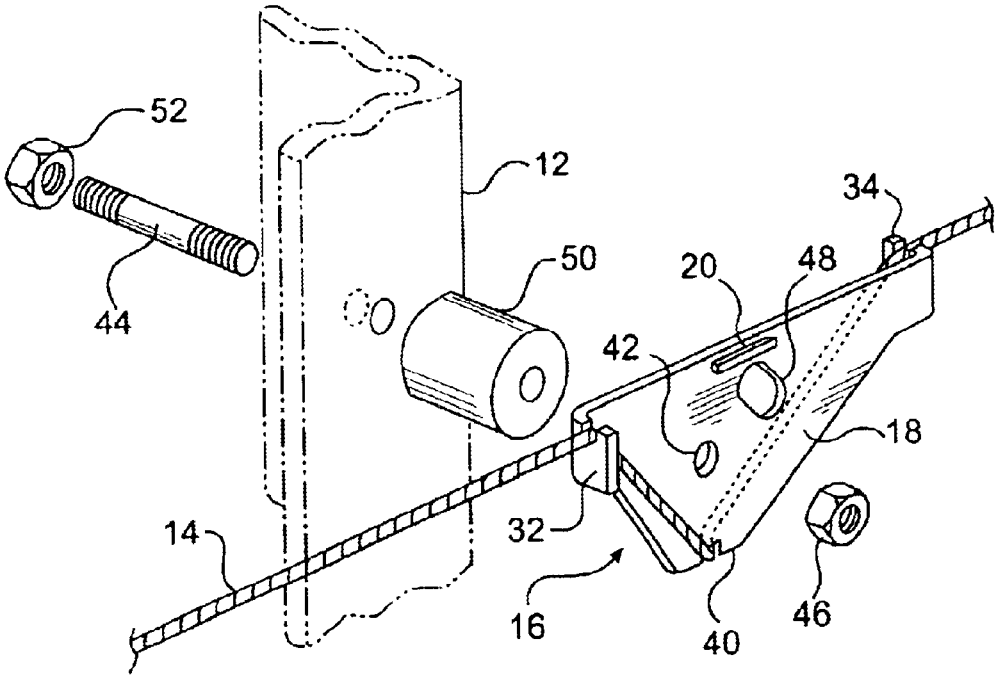
FIG. 5 is an exploded assembly view of the sensor fitted to a fence post.
Figure 6:
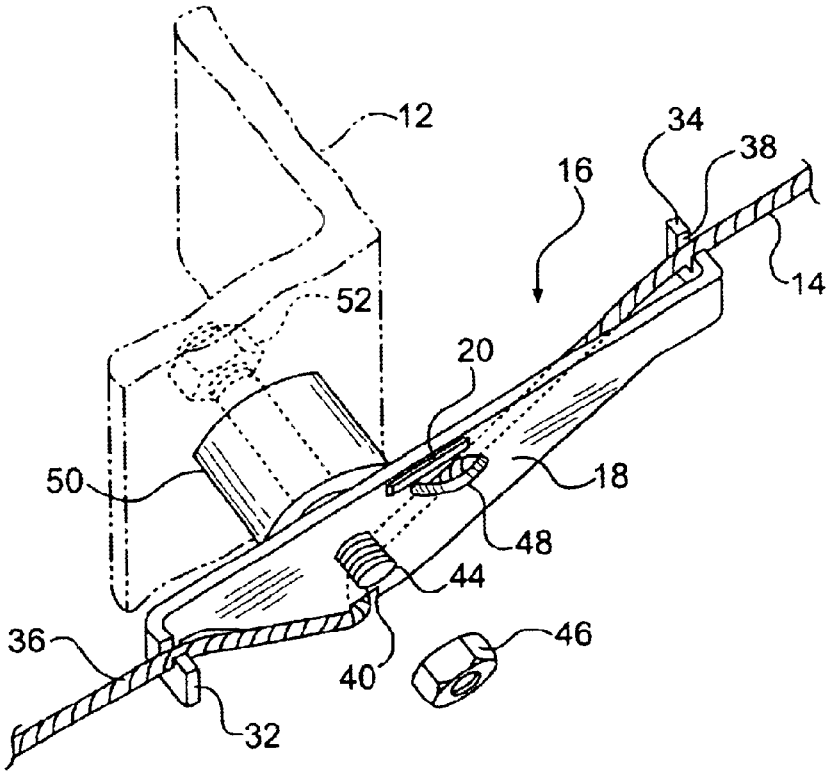
FIG. 6 is an assembly view of FIG. 5 from a top perspective.
Figure 7:
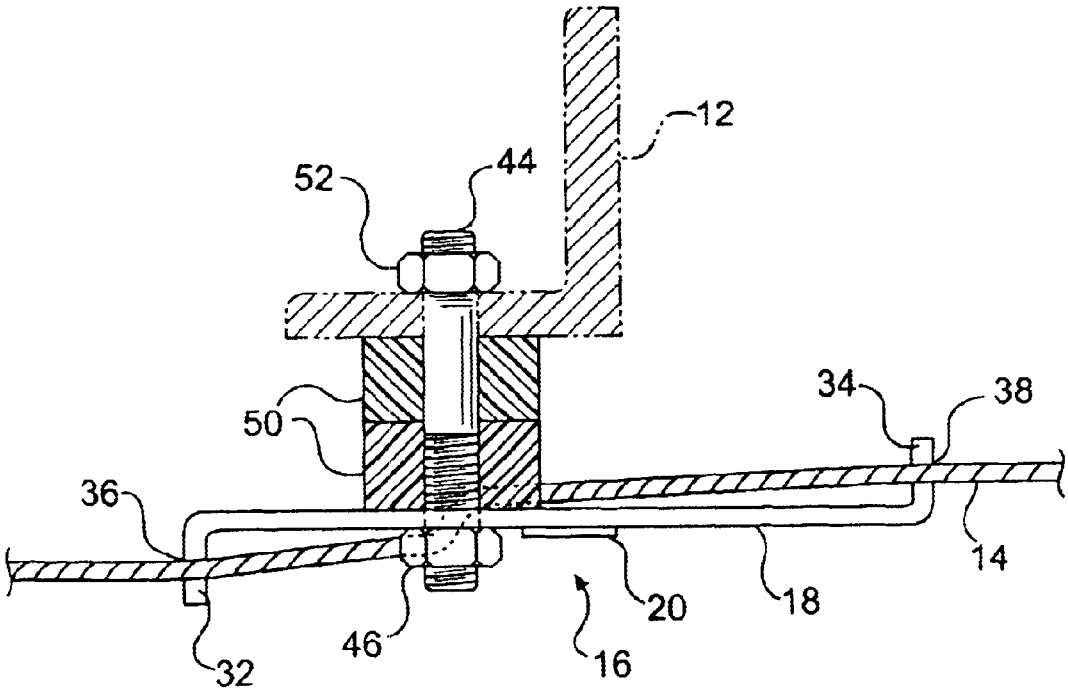
FIG. 7 is a section plan view of FIG. 6.
Figure 8:
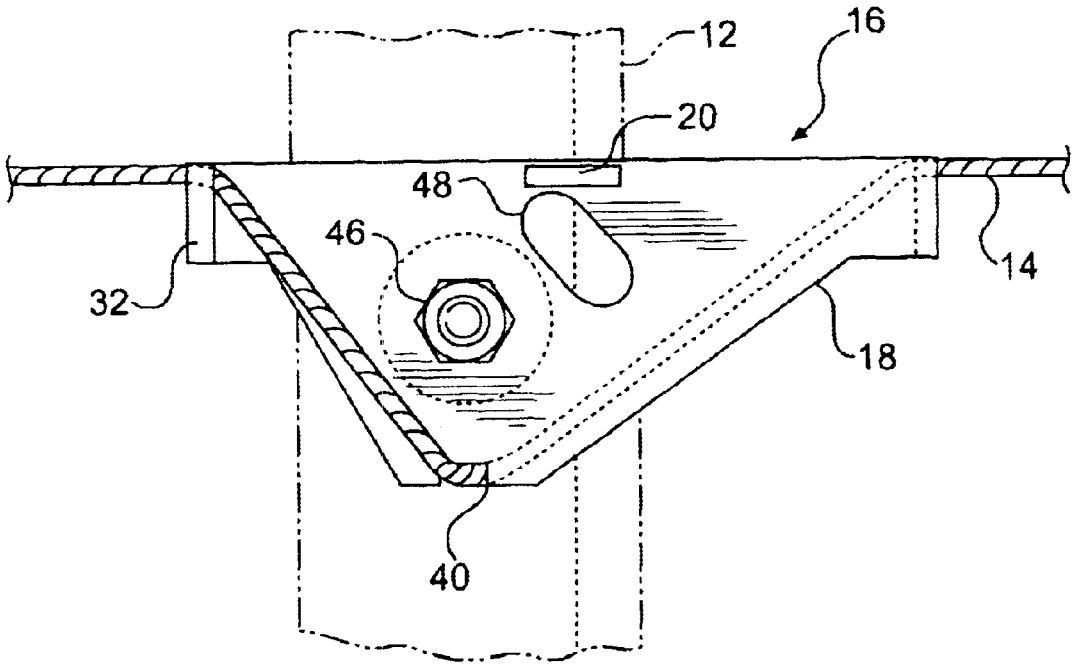
FIG. 8 is a front elevation view of FIG. 6.
Figure 9:
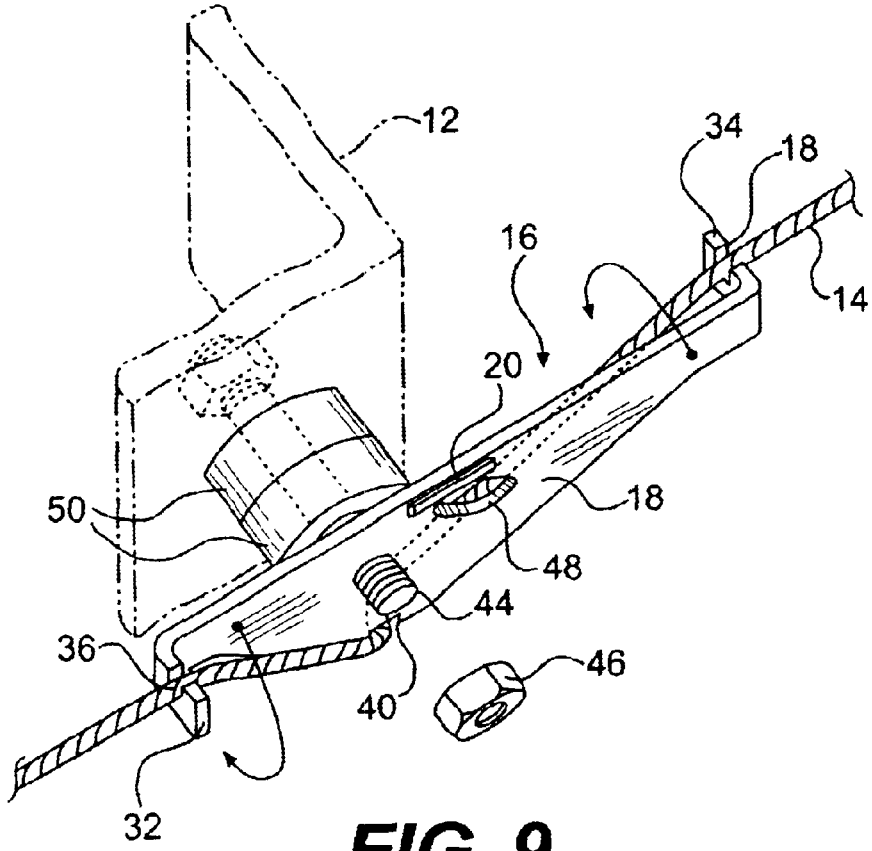
FIG. 9 is a similar view to that of FIG. 6 but having the wire stressed.

Deflection sensors 16 are preferably mounted on shock absorbers 50 and may be in the form of a single absorber element (as shown in FIGS. 5 and 6) or a multi-part absorber as shown in FIGS. 7 and 9. A further nut 52 may be used to fix the deflection sensor 16 to the shock absorber element 50.

In use, each deflection sensor 16 is secured to a respective post/support 12 and wire 14 is fed through slot 36 and across plate member 18 and under further slot 40. From further slot 40 wire 14 passes across the rear of plate member 18 and engages slot 38. As can be seen from FIG. 7 wire 14 does not touch the majority of plate member 18 and will provide an in-line arrangement as opposed to the transverse arrangements of the prior art. This arrangement provides a stronger deflection sensor which will not be damaged if wire 14 or deflection sensor 16 is stood on. The arrangement also ensures that wire 14 does not need to be cut to install or replace a deflection sensor. The offset orientation of mounting hole 42 allows an adjustment of tension by rotating plate member 18 and fastening nut 46 in the desired position.

Figure 10:
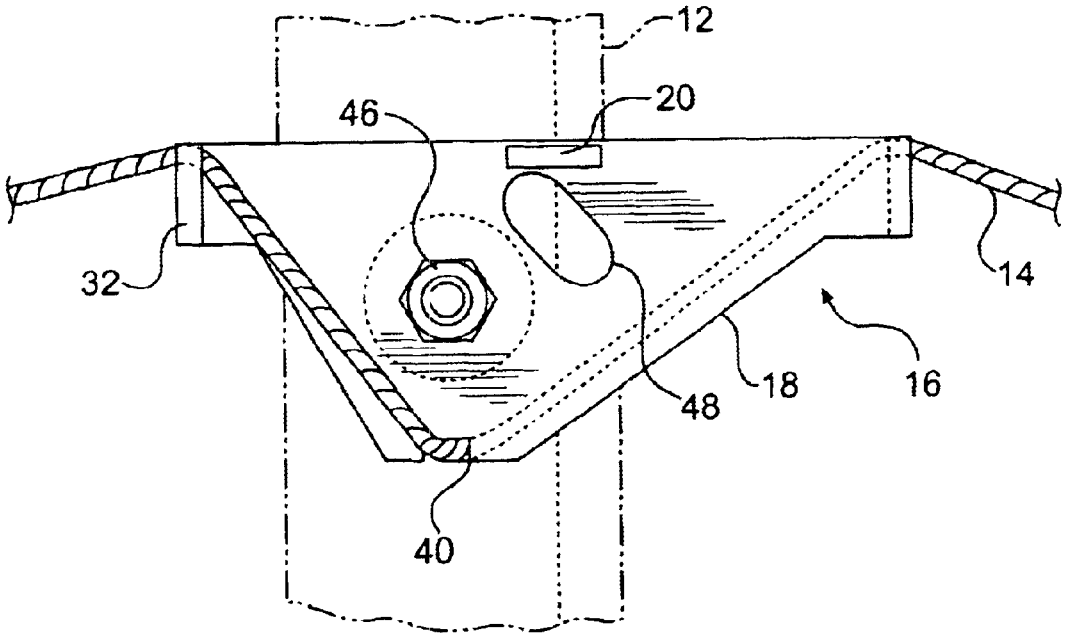
FIG. 10 is a similar view to that of FIG. 8 but having the wire stressed.

FIGS. 9 and 10 illustrate tension being placed on wire 14 by stepping on the wire or moving the wire up or down. FIG. 10 shows the deflection of the horizontal wire resulting from this increased tension and FIG. 9 shows the bending of plate member 18. Transducer 20 will react to this strain by a change in voltage or current which is being continually monitored. This change in voltage or current will be fed to a data processing system for assessment. Similarly, a cut in wire 14 will cause a reduction in stress across plate member 18 which will also result in a change in voltage or current.

Figure 11:
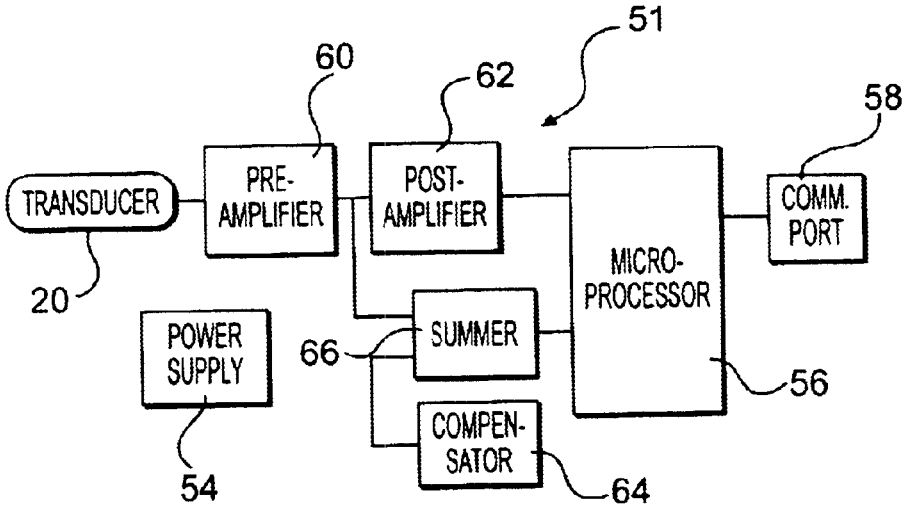
FIG. 11 is a circuit block diagram of an example of a sensor detection system.
Figure 12:
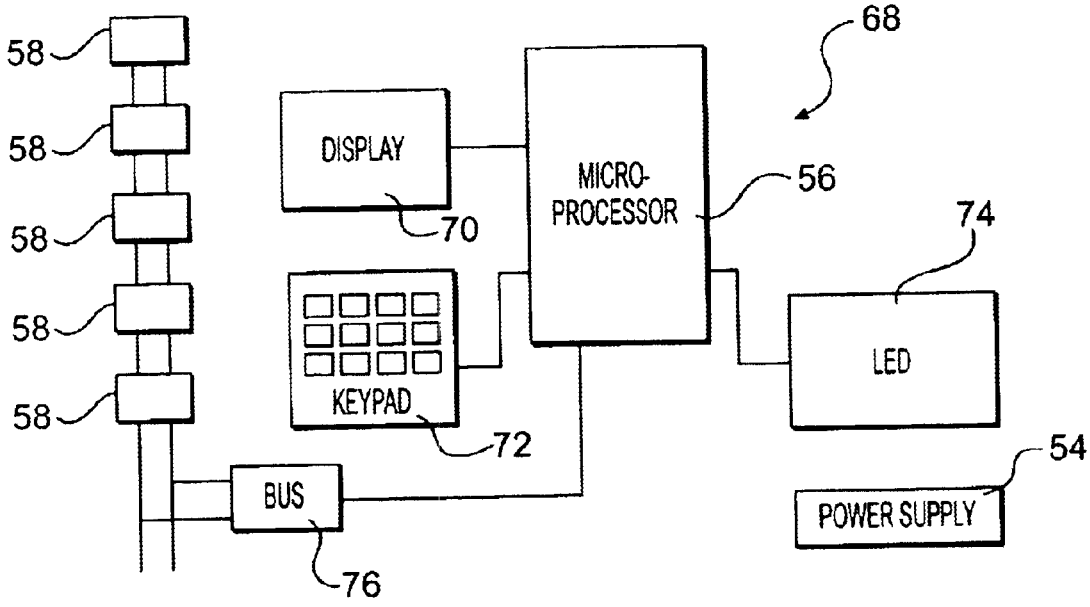
FIG. 12 is a circuit block diagram of an example of a data processing system for monitoring the fence.

The monitoring of the signals from transducers 20 can be done by alarm systems shown and described in the previously mentioned US Patents. A preferred system is illustrated in FIGS. 11 and 12. FIG. 11 shows a block diagram of a circuit 51 to be used with each deflection sensor 16. The circuit can be remote from the deflection sensor or mounted on plate member 18. The circuit is powered by a separate power supply 54 eg battery, or from a single source which supplies power to a group of deflection sensors 16. Each transducer preferably has a stand alone power control system to limit power consumption, protect against power spikes and surges and to maintain isolation between each of the deflection sensors 16. The circuit is controlled by a microprocessor 56 which sends and receives data through a communications port 58 eg an RS485 communications bus. Suitable amplification from transducer 20 is provided by pre- and post amplifiers 60,62 and feedback is provided by compensator 64. A summer 66 combines signals from microprocessor 56 and compensator 64.

In use, microprocessor 56 is programmed to respond to interrogations from the central system 68 (to be described) shown in FIG. 12 through the RS485 communications bus 58. A correctly addressed command returns the transducer level and receives a calculated offset value which is applied to the transducer 20. This forms part of a closed loop feedback controller which runs in conjunction with processing algorithms within the central system 68. Such a design does not rely on automatic gain controls, instead it endeavours to hold a maximum signal to noise ratio and therefore maximise sensitivity. Each transducer 20 adapts itself to the wire it is monitoring. As conditions on wire 14 change, respective microprocessors 56 from each transducer 20 transfer weighting parameters to the central system 68. The central system then examines the weightings across a region of fence wires 14. In this way a wire movement detected on one wire alone is not enough to cause a zone violation alarm. Rather the condition is processed in conjunction with surrounding data and weighted according to the noise history of the wire and the wire group. A wire contact probability is then determined. The final decision as to whether a zone alarm is raised is made by the central system 68. The communications bus 58 is common to all of the sensors 16 across the fence post. Each sensor 16 has a unique post address. A common bus structure is efficient with respect to cabling within the fence post. Power supply and data bus wiring is accomplished using only two wire pairs. Sensor communications are encrypted and any attempt to tamper with the data stream is displayed when illegal or missing data packets are detected. The purpose of placing intelligence at the point of sensing is to allow adaptive algorithms to be implemented by using powerful but low cost microprocessors 56. Over time, the adaptive nature of the circuit gives a high probability of detection combined with a very low false alarm rate. The course of the adaptation may also be controlled by the more powerful central system 68. This provides a second level of supervision over what may seem to be an uncontrolled set of sensor processors.

Experimental results show that the taut wire fence described is best analysed in groups of wires 14 rather than on a wire by wire basis. Disturbances in the fence fabric are not limited to a single fence wire, rather the fence is disturbed across a group of wires. A wire group is defined as any number of wires from two wires to forty wires. A single wire disturbance may be attributed to a climb attempt over the taut wire fence or a wire cutting attack. These conditions are sensed as a gross disturbance function within the processing algorithm. The circuit shown in FIG. 11 provides fence wire scanning controls and distributes the wire weighting parameters and determines the probability of contact of a fence wire group. The distribution algorithm is modified by the parameters determined by each sensor 16.

The central system 68 is shown in FIG. 12. Central system 68 provides the user interface required to set up the taut wire fence system. To this end a four line, twenty character display 70 is provided along with a ten key speed bar keypad 72. The configuration of system 68 is very simple, with the user prompted for "list-box" style data selections. This forces the user interface to accept only valid set up information. LED indication 74 of the state of each of the wires 14 provides instant visual feedback of the wire state. Annunciation of an alarm condition is made locally via voltage free contacts. Tamper and "system trouble" contact outputs are also provided. Interconnection between each circuit 51 for each deflection sensor 16 is made by RS485 bus 58. Interconnection between each central system 68 is made via an external RS485 bus 76. An RS232 port may also be provided for field testing and software upgrades to the central system 68.

The circuits 51 and 68 are preferred methods of using deflection sensors 16 but are not limited thereto. The shape of plate member 18 can also vary to suit circumstances.

The invention will be understood to embrace many further modifications as will be readily apparent to persons skilled in the art and which will be deemed to reside within the broad scope and ambit of the invention, there having been set forth herein only the broad nature of the invention and a certain specific embodiment by way of example.

What is claimed is:

1. A deflection sensor for a taut wire type detection system, wherein said deflection sensor comprising a plate member adapted to be pivotally mounted, a first wire attachment point at one end of said plate member, a second wire attachment point remote from said first wire attachment point and a transducer or sensor element located on said plate member between said attachment points, and wherein said attachment points are formed from tabs bent from said plate member to extend on opposite sides of said plate member and said tabs include a slot for reception of said wire.

2. The deflection sensor of claim 1, wherein said attachment points are at opposite ends of said plate member and/or on opposite sides of said plate member.

3. The deflection sensor of claim 1, wherein said plate member includes a further slot at the bottom of said plate member to guide the wire from one side to the other side of said plate member.

4. The deflection sensor of claim 3, wherein said plate member is substantially triangular in shape.

5. The deflection sensor of claim 1, wherein a cut out or slot is formed in said plate member adjacent said transducer to increase the sensitivity of said sensor.

6. The deflection sensor of claim 1, wherein said sensor is pivotally mounted on a shock absorber means.

7. The deflection sensor of claim 1, wherein said transducer or sensor element is a strain gage device.

8. A taut wire type detection system comprising at least one taut wire for a perimeter fence supported by a plurality of posts, at least one deflection sensor, wherein said deflection sensor includes a plate member adapted to be pivotally mounted, a first wire attachment point at one end of said plate member, a second wire attachment point remote from said first wire attachment point and a transducer or sensor element located on said plate member between said attachment points, and wherein said attachment points are formed from tabs bent from said plate member to extend on opposite sides of said plate member and said tabs include a slot for reception of said wire, said at least one deflection sensor being pivotally mounted to one of said posts or a support thereon and a sensor processing circuit for interrogating said at least one deflection sensor and to provide an alarm indication on tampering of said at least one taut wire or said at least one deflection sensor.

9. The taut wire detection system of claim 8, wherein a plurality of said at least one taut wires are provided and each taut wire has at least one of said deflection sensors attached thereto together with a respective sensor processing circuit, and each sensor processing circuit is coupled to a central processing system.

* * * * *